US008196890B1

(12) United States Patent
Lien

(10) Patent No.: US 8,196,890 B1
(45) Date of Patent: Jun. 12, 2012

(54) HANGING MERCHANDISE DISPLAY SYSTEM

(75) Inventor: Khoa T. Lien, Milton, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 13/017,398

(22) Filed: Jan. 31, 2011

(51) Int. Cl.
*A47B 97/00* (2006.01)

(52) U.S. Cl. ..... 248/528; 211/72; 211/85.15; 248/95; 248/459

(58) Field of Classification Search ..... 248/95, 248/682, 459, 150, 450, 528; 206/294, 529; 211/12, 82.15, 72, 73
See application file for complete search history.

(56) References Cited

U.S. PATENT DOCUMENTS

| | | | | |
|---|---|---|---|---|
| 2,850,160 | A | 9/1958 | Siebel et al. | |
| 3,142,436 | A | 7/1964 | Heigl | |
| 3,458,037 | A | 7/1969 | Larson | |
| 3,650,442 | A | 3/1972 | Berns et al. | |
| 4,134,533 | A * | 1/1979 | Heavner | 206/509 |
| 4,190,151 | A | 2/1980 | Russell | |
| 4,476,619 | A | 10/1984 | Palmer | |
| 5,479,732 | A * | 1/1996 | Burtch et al. | 40/124.16 |
| 5,555,991 | A * | 9/1996 | Hart | 211/73 |
| 5,915,564 | A | 6/1999 | Hsi Chang | |
| 6,080,184 | A | 6/2000 | Peters et al. | |
| 6,186,934 | B1 | 2/2001 | Addison | |
| 6,237,762 | B1 | 5/2001 | Faircloth | |
| 6,311,845 | B1 | 11/2001 | Uren et al. | |
| 6,386,368 | B1 | 5/2002 | Pirro | |
| 6,471,053 | B1 | 10/2002 | Feibelman | |
| 6,488,147 | B2 | 12/2002 | Mattesky | |
| 6,612,431 | B2 | 9/2003 | Faircloth | |
| 6,622,858 | B1 | 9/2003 | Wilkinson et al. | |
| 6,647,697 | B1 * | 11/2003 | Zarrow et al. | 53/452 |
| 6,981,588 | B2 | 1/2006 | Kimura | |
| 7,281,344 | B2 | 10/2007 | Knauf | |
| 7,464,816 | B2 | 12/2008 | Klein et al. | |
| 7,699,170 | B2 | 4/2010 | Klein et al. | |
| 2006/0011785 | A1 * | 1/2006 | McLean | 248/95 |
| 2006/0042986 | A1 | 3/2006 | Simkowski | |
| 2007/0125669 | A1 * | 6/2007 | Lee et al. | 206/286 |
| 2007/0194201 | A1 * | 8/2007 | Dempsey | 248/459 |
| 2007/0235599 | A1 * | 10/2007 | Seidl | 248/95 |

FOREIGN PATENT DOCUMENTS

| | | | |
|---|---|---|---|
| EP | 1 790 579 | A1 | 5/2007 |
| FR | 2610298 | A1 * | 8/1988 |
| JP | 2001097399 | A * | 4/2001 |
| WO | WO 2005/056422 | A2 | 6/2005 |
| WO | WO 2006/122176 | A1 | 11/2006 |
| WO | WO 2009/013472 | A1 | 1/2009 |

* cited by examiner

*Primary Examiner* — Ramon Ramirez
(74) *Attorney, Agent, or Firm* — James B. Robinson

(57) ABSTRACT

There is provided a display system that may be hung and that holds one or more pouches or bags containing an item to be used. The display is made from a blank having upper, middle and lower panels and an upper edge. There is a tab arrangement on the upper panel for holding the merchandise to be displayed. The bags are inserted from the back of the blank between the upper and middle panels and attached to the tab arrangement. After the bags are attached to the tab arrangement, the upper edge of the upper panel is inserted between the lower and middle panels and the lower panel is folded over the upper panel in order to hold the bags relatively firmly on the tab arrangement. The display may then be hung by the use of slots or hooks in the upper panel.

14 Claims, 9 Drawing Sheets

HANGING MERCHANDISE DISPLAY SYSTEM

The present disclosure relates to a system for packaging and displaying merchandise for easy access.

Various devices have been utilized in the past to hold and display numerous products to consumers and users. Display cards have been utilized to expose a variety of products to consumers such as jewelry, buttons, tooth brushes, nuts and bolts and other smaller size products. Regardless of the type of product displayed, ideally the display card and product should be relatively easy to assemble, and the card should display the item in an aesthetically appealing and easily accessible manner. Previously known display cards may include a generally planar outer surface having a member to secure the article thereto, and a hook or aperture for engaging a support member such as a display rack or rod. The securing member may take a variety of forms, depending upon the type of article supported on the display card.

In addition to display cards, bags or pouches have also been utilized to hold and display products to consumers. In some cases the bags or pouches are part of a package which is displayed on a support member. For example, U.S. Pat. No. 2,850,160 to Siebel et al. discloses a package including an inner, transparent container or envelope for holding a product, and a window which permits direct viewing through the package of the packaged product. An aperture may be provided in the tongue for mounting or displaying the package from a rod, or the like. U.S. Pat. No. 5,184,724 to Mayled likewise discloses a package for supporting a flexible, transparent pouch which holds small items therein. The package includes an opening through which a portion of the pouch is visible so that consumers can see items in the pouch. U.S. Pat. No. 5,915,564 to Chang provides a cardboard package for holding individual items that allows access to the item prior to removal from the package. Chang provides slots and tabs for assembly of the package but only holds one item per package. In addition, U.S. Pat. No. 6,186,194 to Addison discloses a hanger bag including a hanger that is an internally profiled hook dimensioned so as to receive a rod within the perimeter of the package, thereby making the package more compact. With each of the above display pouches, the pouch or envelope is bonded or otherwise formed as part of the display card. It is not intended, therefore, to be utilized separately from the display card itself. In addition, multiple product display pouches are not contemplated to be utilized with each hanging package.

Of particular interest here are displays that may be placed in a hospital setting for supply of items that are frequently used. These items may be used in the individual patient room, for example, and may be used once or twice per shift, or every 4 to 8 hours. An example of this is personal grooming materials that are disposed of after each use. Another example is the packaging of oral hygiene products that are, again, disposed of after each use. A ready supply of such items is required in order to reduce the time that hospital personnel spend on procuring them. Searching in a remote supply room for the needed item each time it was to be used would waste quite a bit of hospital personnel time.

SUMMARY

The present disclosure describes a display system that may be hung and that holds one or more pouches or bags containing an item to be used. The items are enclosed in a bag that may be made of a recyclable material such as a plastic like polyethylene.

In its broadest embodiment, the disclosed display is made from a blank having upper, middle and lower panels and an upper edge. The panels are distinguished from each other by fold lines. There is a tab arrangement on the upper panel for holding the merchandise to be displayed and there is desirably a means for hanging the display device also located on the upper panel. The bags have a slit for attaching them to the blank on the tab arrangement. The bags are inserted from the back of the blank between the upper and middle panels and attached to the tab arrangement. After the bags are attached to the tab arrangement, the upper edge of the upper panel is inserted between the lower and middle panels and the lower panel is folded over the upper panel in order to hold the bags relatively firmly on the tab arrangement. The display may then be hung by the use of slots or hooks in the upper panel.

The bags desirably have a line of perforation or weakness that allows them to be pulled apart so that the lower part of the bag containing the items may be removed from the display while the upper part of the bag remains attached to the display.

DETAILED DESCRIPTION

Reference will now be made to the drawings in which the various elements of the present disclosure will be given numeral designations and in which the disclosure will be discussed so as to enable one skilled in the art to make and use the disclosure. It is to be understood that the following description is only exemplary of the principles of the present disclosure, and should not be viewed as narrowing the pending claims. Those skilled in the art will appreciate that aspects of the various embodiments discussed may be interchanged and modified without departing from the scope and spirit of the disclosure.

Figure 1:
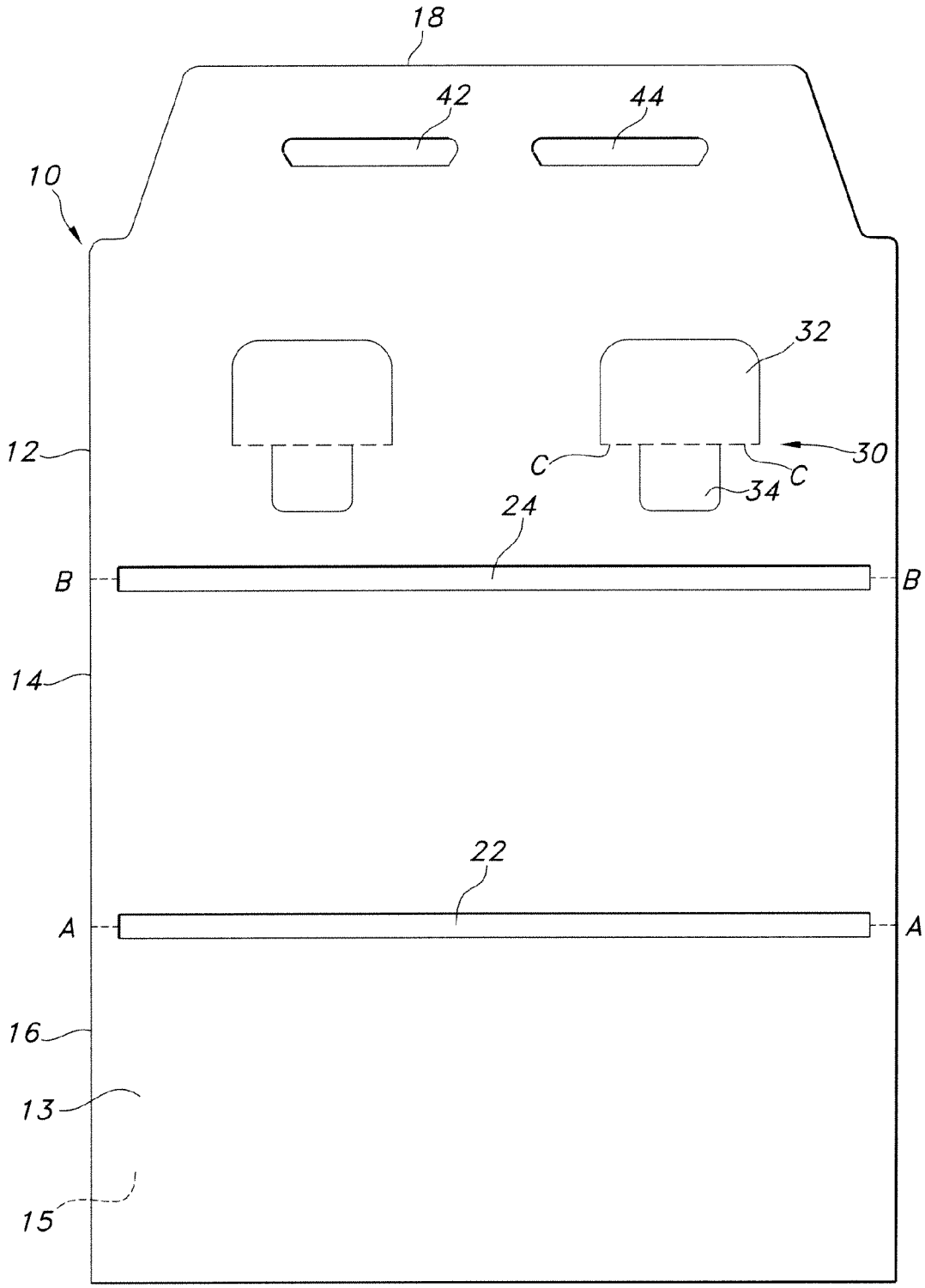
FIG. 1 is a front view of a blank from which the handing merchandise display system may be made. The blank has an upper, middle and lower panel, each separated by fold lines and optionally a slot. This blank has tabs that fold outwardly to accept the container (e.g. bag) for the merchandise to be displayed.

Turning to the drawings, FIG. 1 illustrates a general embodiment of the disclosed merchandise hanging display system. The system is made from a blank 10 of a relatively stiff paperboard, plastic or equivalent material that is sufficiently strong so as to support the merchandise when the system is hung. The blank 10 has a front 13 and a back 15 and may be divided into three sections; an upper panel 12 a middle panel 14 and a lower panel 16. The panels are distinguished or divided from each along fold lines. Fold line A-A divides the lower panel 16 from the middle panel 14 and fold line B-B divides the middle panel 14 from the upper panel 12. There is desirably a lower or first slot 22 along fold line A-A that is sufficient in size to allow the insertion of the upper edge 18 of the blank 10 into the slot 22 when the blank 10 is folded. Another (upper or second) slot 24 is desirably located between the middle panel 14 and the upper panel 12 along fold line B-B. This upper slot 24 is for the insertion of merchandise to be hung, and will be more fully discussed below. It should also be noted that the slot width need only be sufficient for the insertion of the merchandise bag or other panel and so may only be a slit.

Alternatively, the three panels 12, 14, 16 may be separate pieces, not made from the same blank. In this case the panels may be connected together at their edges to produce a tri-fold blank as shown in FIG. 1. The connection may be by, for example, hinges attached to each panel, hook and loop connections or other means known to those skilled in the art. It is important that the panels still be able to fold against each other and that they may be separated for the insertion of the bags or other panel.

Figure 3:
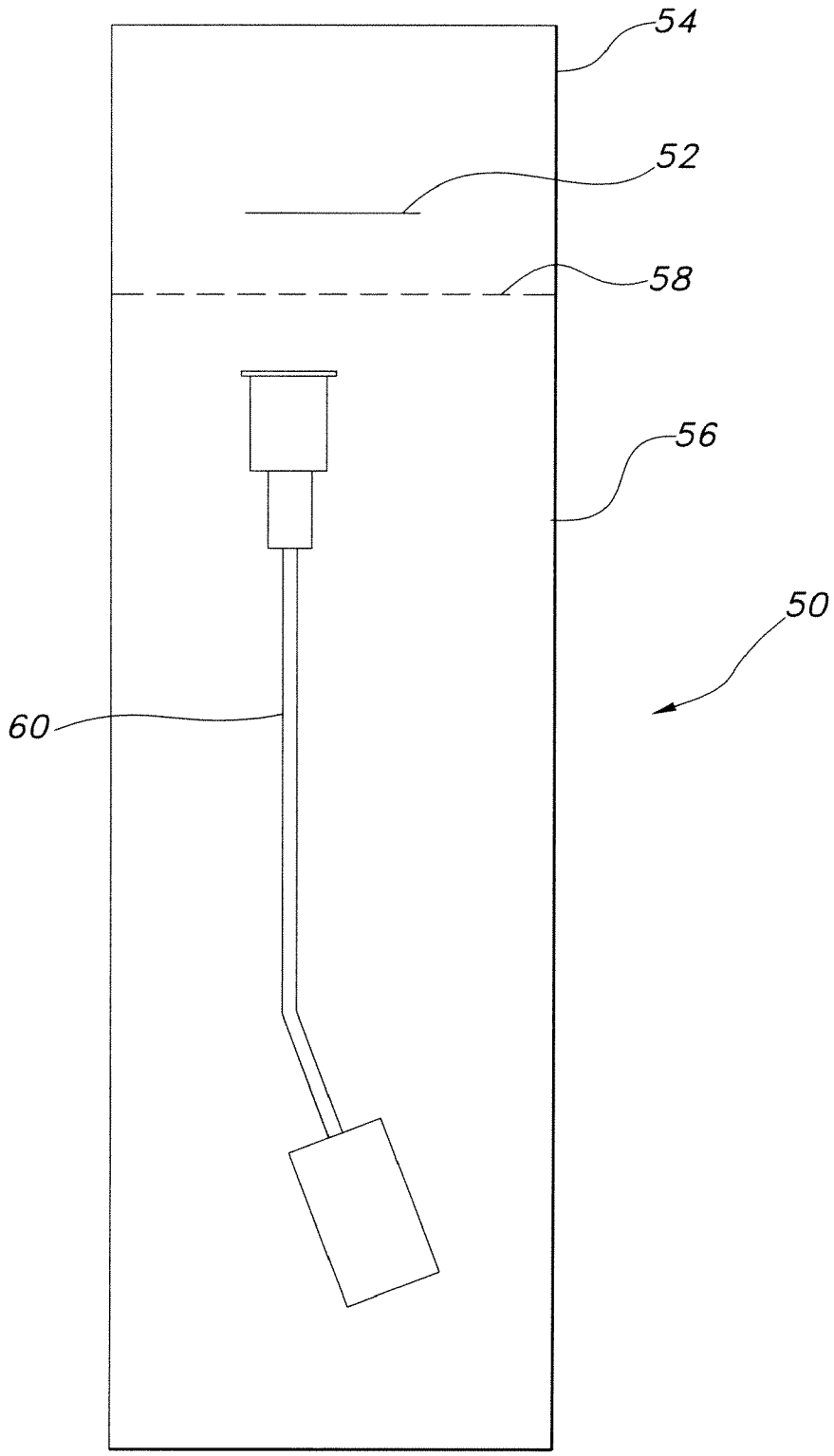
FIG. 3 is a view of a polymeric bag for holding the merchandise to be displayed. The bag has a slit for attaching it to the tabs on the blank and desirably, a line of weakness for separating the lower and upper parts of the bag for removal from the display.

The upper panel 12 has at least one tab arrangement 30 used for securing the merchandise. As shown in FIG. 1, the tab arrangement 30 has two tabs; an upper tab 32 and a lower tab 34. These are cut from the blank 10 and have a common hinge or fold along line C-C, though a common hinge is not required and the tabs may be separated from each other by a distance. This aspect will be discussed in greater detail below. The merchandise 60 to be hung is placed in a plastic bag 50 (FIG. 3) having an aperture or slit 52 at its upper portion or end 54. The bag 50 also desirably has a score line or perforation 58 to aid in separating the lower part 56 of the bag 50 that contains the merchandise 60 from the upper end 54 of the bag 50 on the completed hanging display so that the merchandise 60 may be removed for use.

Figure 4:
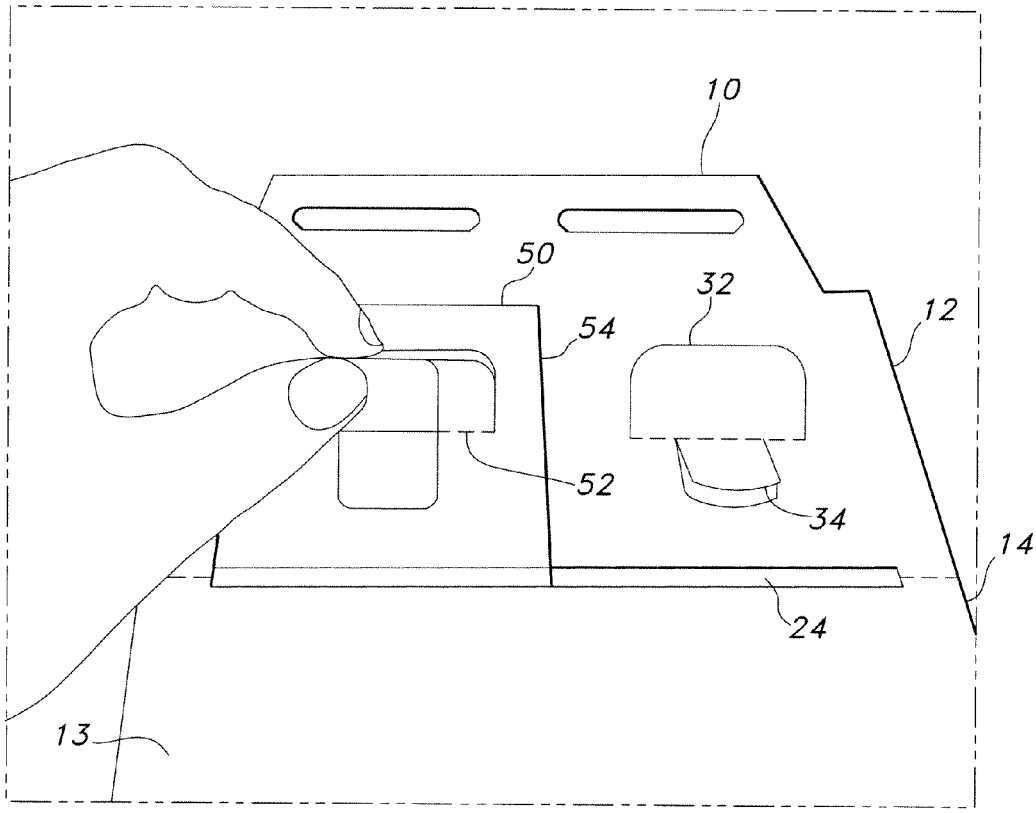
FIG. 4 is a view of a bag being attached to the tabs after being inserted into the slot between the upper and middle panels. The tabs are squeezed together and inserted into the slit in the bag.
Figure 5:
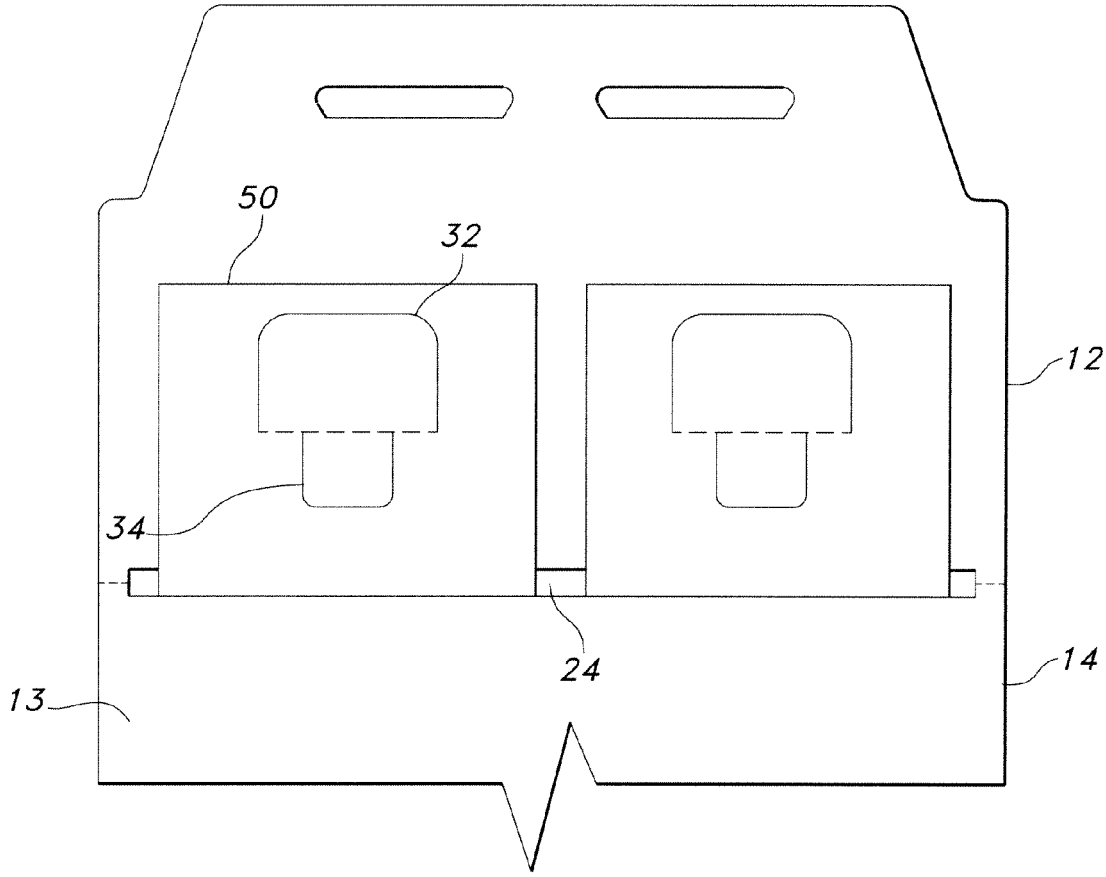
FIG. 5 is a view of the bag(s) on the blank after the tabs have been inserted through the slit and the tabs moved back toward their original positions so as to hold the bag on the tabs.

In assembling the display, the upper end 54 of the plastic bag 50 is inserted from the back side 15 of the blank 10 through the slot 24 (FIG. 4). The tabs 32, 34 are bent away from the blank 10 (i.e. towards the viewer of the Figure) until they come together and then the tabs 32, 34 are inserted through the slit 52 of the bag 50. The tabs 32, 34 are then pushed toward or allowed to return to, their original positions substantially flat against the blank 10, thus holding the bag 50 against the blank 10 (FIG. 5). As mentioned above, there may be more than one tab arrangement 30 per blank 10 and each tab arrangement 30 may hold one or more bags 50.

Figure 6:
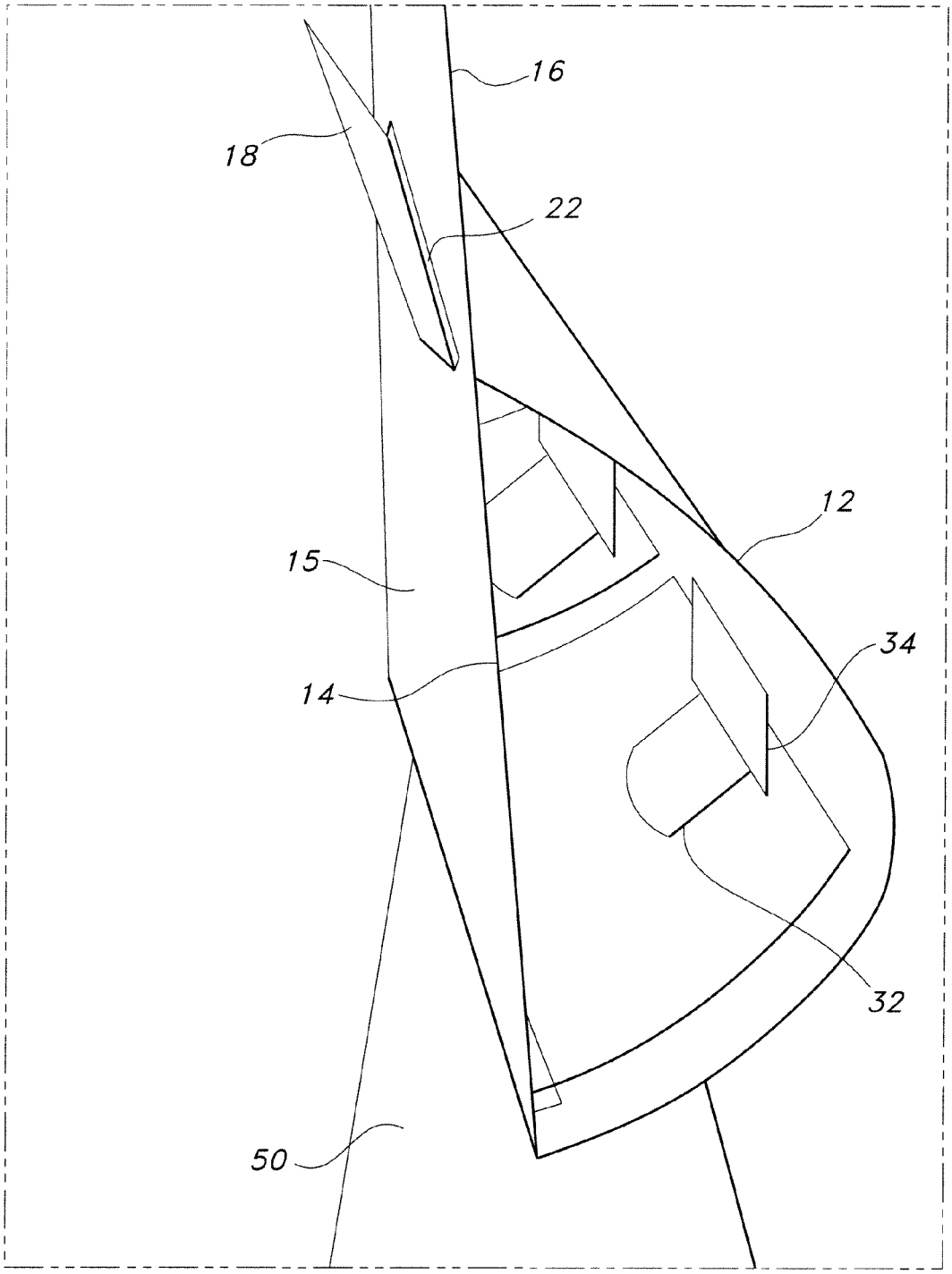
FIG. 6 is a view of the tabs as the upper edge of the upper panel is inserted into the slot between the middle and lower panels as seen from the side. The tabs should remain flat (as in FIG. 5) and then be held in position by the middle panel, against which they rest.
Figure 7:
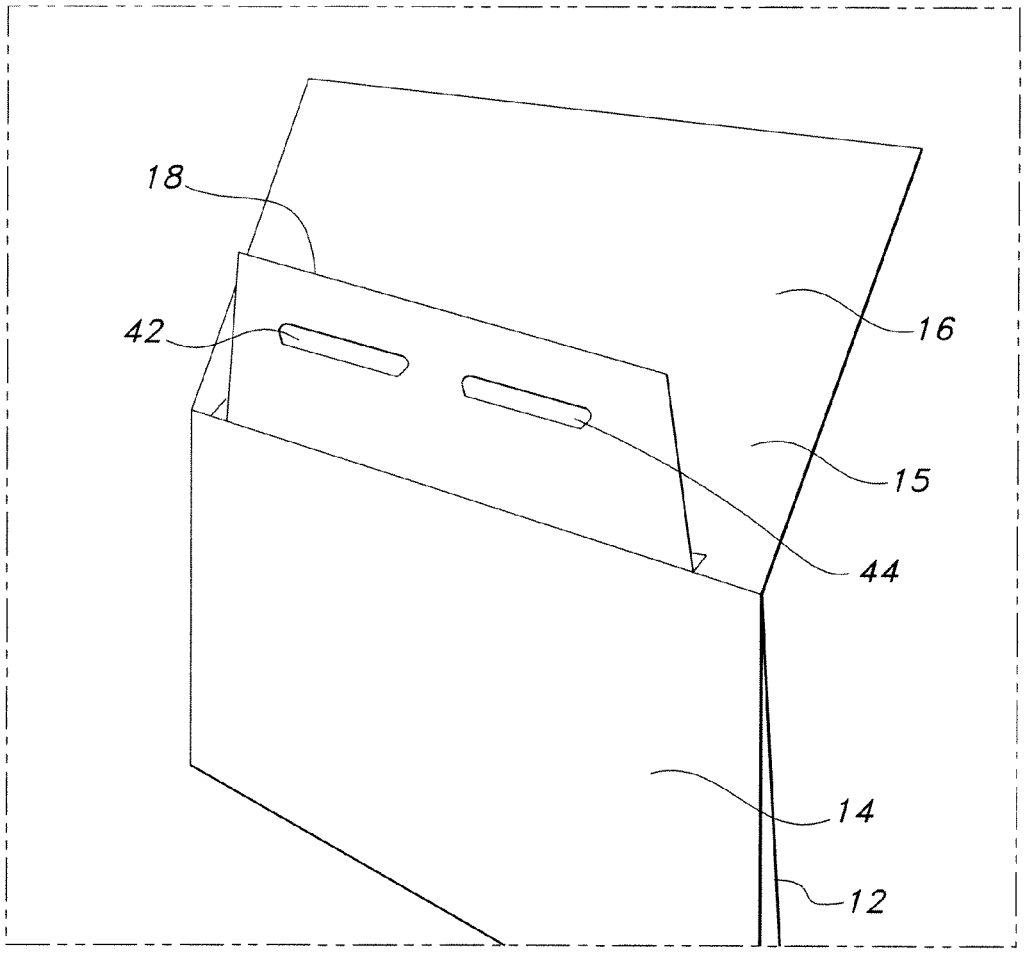
FIG. 7 is another view of the blank as the upper edge of the upper panel is inserted into the slot between the middle and lower panel. The lower panel is shown in the process of being folded down over the back of the upper panel.

When the desired number of bags 50 has been attached to the tabs 32, 34, the middle panel 14 may be folded upward over the tab arrangement 30 (i.e. on the front side). The upper edge 18 of the blank 10 may be inserted through the slot 22 between the middle panel 14 and the lower panel 16, folding along line A-A (FIG. 6). Lastly, the lower panel 16 is brought down against the back of the upper panel 12 by folding along line B-B (FIG. 7). In this fashion, the middle panel 14 holds the tabs 32, 34 in place, which in turn holds the bags 50 in place. The lower panel 16 may be attached to the back of the upper panel 12 in any appropriate manner if desired.

The upper panel 12 may also have means for hanging the completed display. One convenient way to hang the display is by the use of a hanging slot(s) 42, 44 such as illustrated in FIG. 1 that are designed to accept a typical display holder. Alternatively, a hook may be cut from or added to the blank 10 at the upper edge 18 so that the display may be hung from a suitable peg or rod.

The blank 10 may be made from any suitably flexible material. Suitable materials include plastics, cardboard and desirably, solid bleached sulfate (SBS) board, a premium paperboard grade. The blank 10 can vary in size depending on the item to be displayed. In one embodiment, the display may be used to contain items to be used in a patient's hospital room for oral care purposes. In this case, suitable cleaning, suction and washing supplies would be supplied in the bag 50. Oral hygiene is performed desirably at least once per eight hour shift, so a plurality of kits (e.g. bags) are necessary in a single day, with each bag containing all the materials that are needed for each oral cleaning. A display may be designed, for example, with the proper number of oral care kits (bags) for an entire week of care for a single patient. This would ensure a ready supply of materials for each patient and minimize searching for supplies by the hospital personnel. The display having a week's supply could be attached to the wall of the patient's room in a convenient location and marked with the date of installation. In the case of an oral care display, for example, the blank 10 may be about 20 to 40 cm in length, desirably about 30 cm in length, and about 10 to 30 cm wide, desirably about 19 cm wide. The slots between the panels may be about 0.3 to 0.8 cm in width, desirably about 0.6 cm. The blank 10 may have a thickness from a positive amount to about 4 mm.

The panels need not be of equal size. The upper panel for example may be larger than the middle and lower panels because the upper panel desirably contains the means for hanging the completed display. The lower and middle panels are desirably about the same length and are about 7 to 10 cm long, desirably about 8.25 cm long, for an oral care display, for example.

Figure 2:
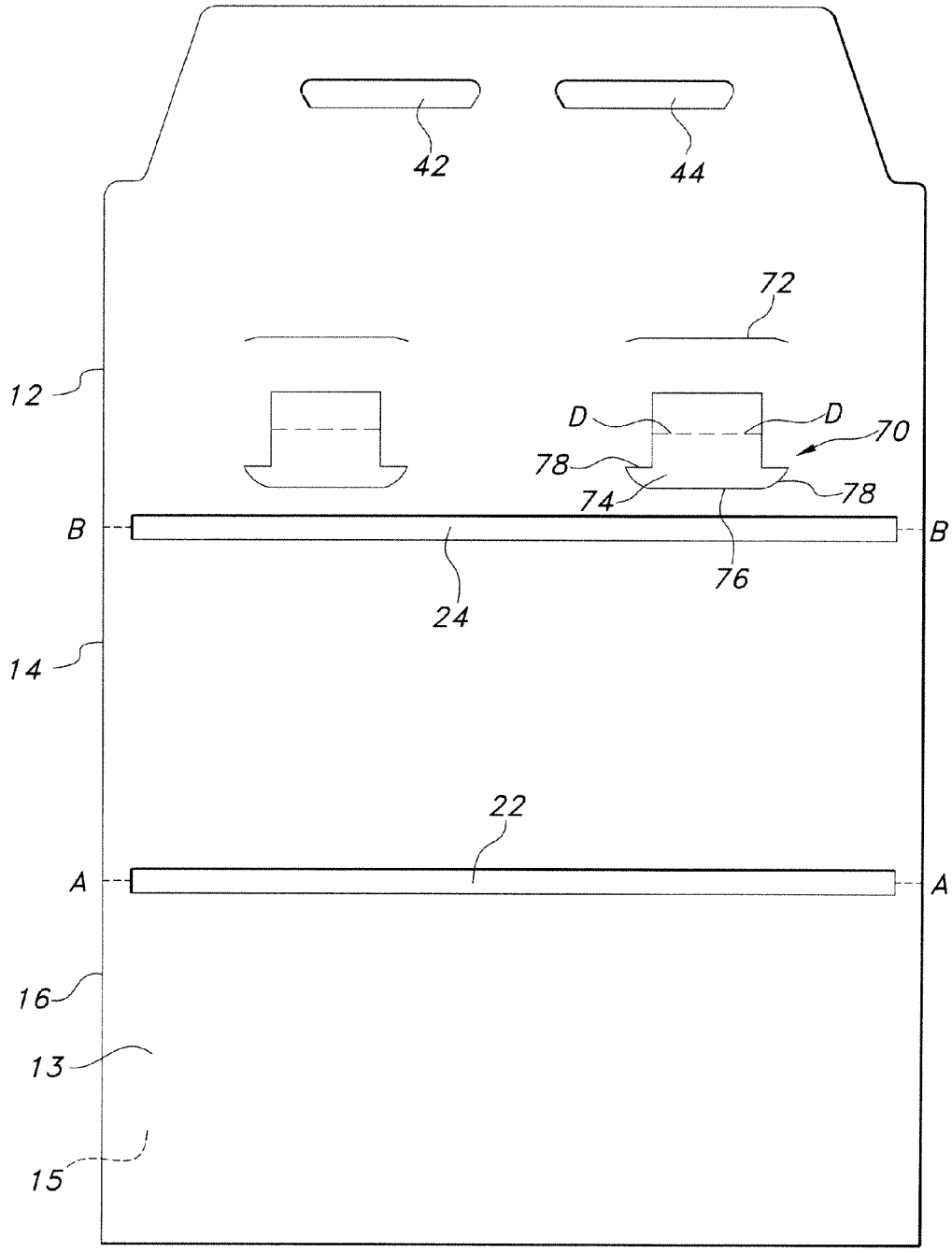
FIG. 2 is a front view of a blank from which the handing merchandise display system may be made. The blank has an upper, middle and lower panel, each separated by fold lines and optionally a slot. This blank has an alternative tab that folds outwardly to accept the container for the merchandise to be displayed and then can lock into the blank for greater holding power.

Turning now to FIG. 2 there is illustrated an alternative type of tab for holding the bags 50 that may provide more holding strength. This alternative tab arrangement 70 has a tab 74 that is cut from the blank 10. There is also a slit 72 cut into the blank 10 that is sized to allow the leading edge 76 of the tab 74 to fit into it. The tab 74 may optionally also have a fold line D-D to aid in inserting the tab 74 into the slit 72. The tab 74 desirably has wings 78 on each end of the edge 76 which will be retained in the slit 72 once the tab 74 is inserted. It is believed that this will provide more holding power than only having the middle panel 14 laying against the upper panel 12 to hold the tabs in place as in the embodiment of FIG. 1. In this alternative embodiment, the bags 50 are inserted from the back through the slot 24 in the same manner as in the embodiment of FIG. 1, the alternative tab 74 is inserted through the slit 52 of the bag 50, and the alternative tab 74 is inserted into the slit 72. Lastly, the upper edge 18 of the blank 10 may be inserted through the slot 22 between the middle panel 14 and the lower panel 16 and the lower panel 16 brought down against the back of the upper panel 12.

As shown in FIG. 4, the bags 50 are inserted from the back side 15 of blank 10, through the slot 24 between the upper and middle panes 12, 14. The bags have a slit 52 on the upper portion 54 through which the tabs 32, 34 are inserted. Prior to insertion through the slit 52, the tabs 32, 34 are bent together, i.e., perpendicular to the blank 10, so that they will pass through the slit 52. There may be a plurality of bags on each set of tabs 32, 34 and there may be a number of sets of tabs 32, 34. FIG. 4 shows a blank 10 having two sets of tabs 32, 34.

After the bags 50 are inserted through the slot 24 and the tabs 32, 34 are inserted into the slit 52, the tabs are moved back towards their starting position, i.e., flat against the blank 10. This position is shown in FIG. 5. The movement of the tabs 32, 34 back toward the blank 10 "locks" the bags into position by flattening the tabs 32, 34, making the tabs too large to pass back through the slit 52. Pulling downwardly on the bags 50 at this point, however, would cause the tabs 32, 34 to again move into a position perpendicular to the blank 10 and would allow the bags 50 to slip off the tabs 32, 34.

As seen in FIG. 6, the next step in securing the bags 50 to the blank 10 is to insert the upper edge 18 of the upper panel 12 into the lower slot 22. This should be done while making sure that the tabs 32, 34 remain substantially flat against the blank 10. FIG. 6 is a view of the procedure from the side, allowing a view of the tabs 32, 34 as the upper panel 12 is inserted into the lower slot 22.

FIG. 7 shows the upper edge 18 of the upper panel 16 fully inserted into the lower slot 22 so that the upper and middle panels 12, 14 lie flat against each other. The lower panel 16 is shown in the process of bending downwardly against the back of the upper panel 12. In this position, the middle panel 14 keeps the tabs 32, 34 substantially flat against the upper panel 12 so that the bags 50 are kept in position.

Figure 8:
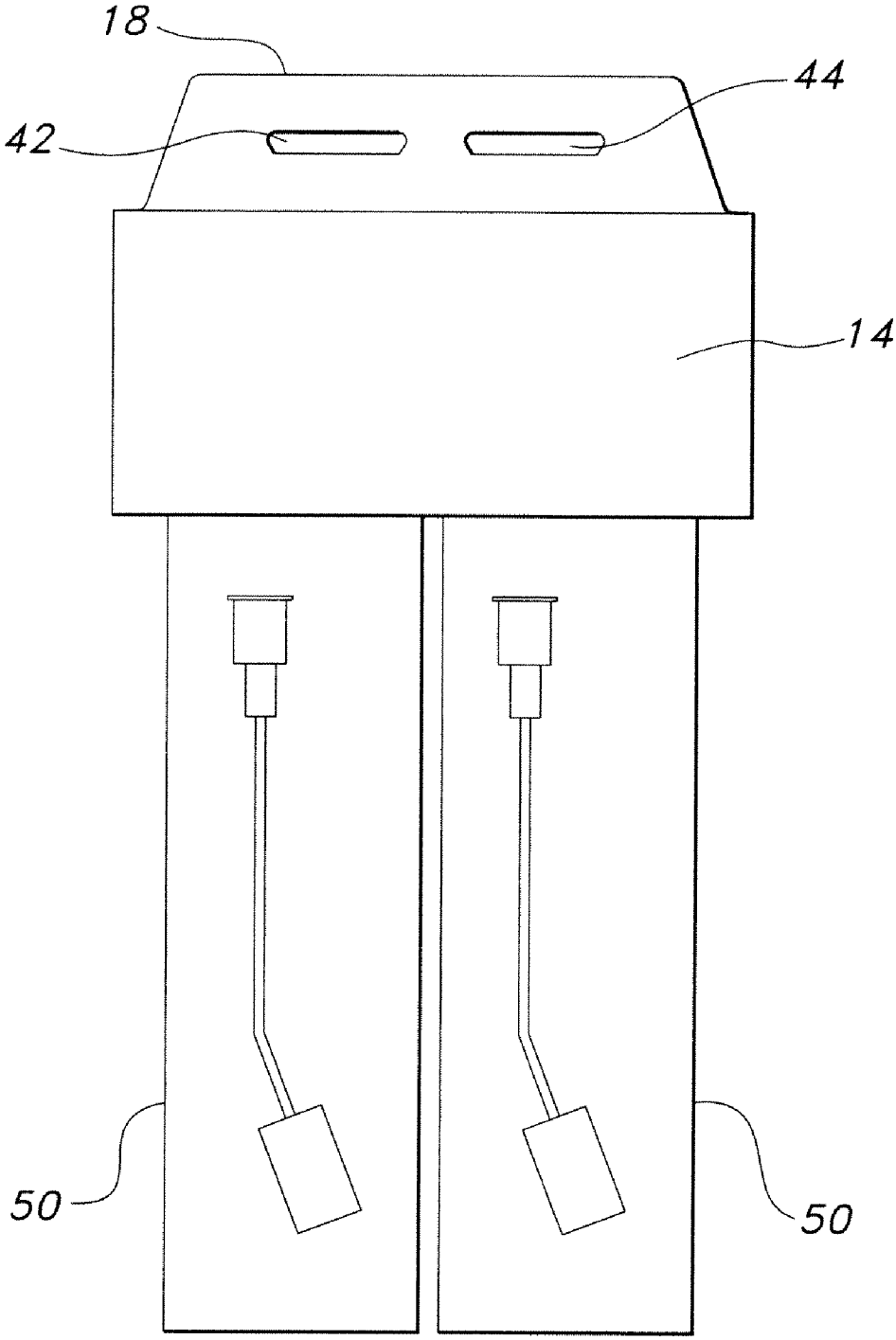
FIG. 8 is a view of the completed assembly showing multiple bags attached to the blank. The blank has been folded to result in the final display, with slots apparent for hanging.

FIG. 8 shows the completed display. In this FIG. 8, there are two sets of tabs 32, 34 (not visible), each holding a plurality of bags 50. The blank 10 has been folded so that the middle panel 14 is against the upper panel 12, holding the tabs 32, 34 in position against the blank 10 (or upper panel 12), though the upper panel 12 is not visible in this view. The lower panel 16 has been folded down against the back of the upper panel 12 to complete the display. Means for hanging the completed display, in this case slots 42, 44, may be provided to allow for convenient display or storage of the completed unit.

Folding the lower panel 16 downwardly against the back of the upper panel 12 completes the assembly of the display, as mentioned above. For most applications it is believe that no additional means of holding the panels in this position are necessary. There may be applications, however, in which even greater holding power is desired. In such cases, auxiliary attaching means may be used. The lower panel may be attached to the upper panel in their final position with glue, staples, hook and loop fasteners, tape or other known fasteners, for example. This would ensure that the display would not be pulled apart when a user removed one of the bags containing the merchandise.

Figure 9A:
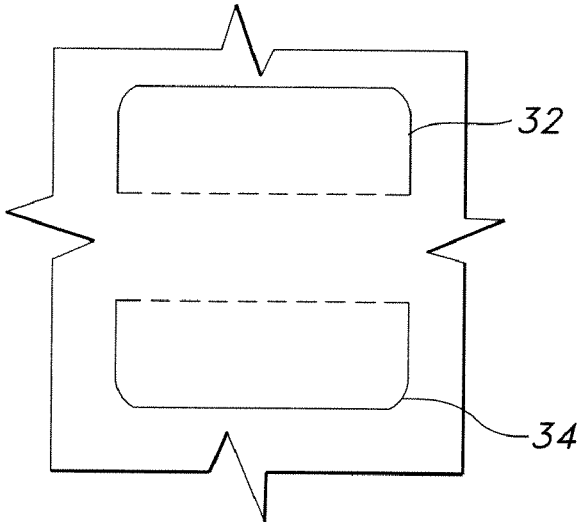
FIGS. 9A, B and C are drawings of alternative tab designs showing the spacing and a generally rectangular shape.
Figure 9B:
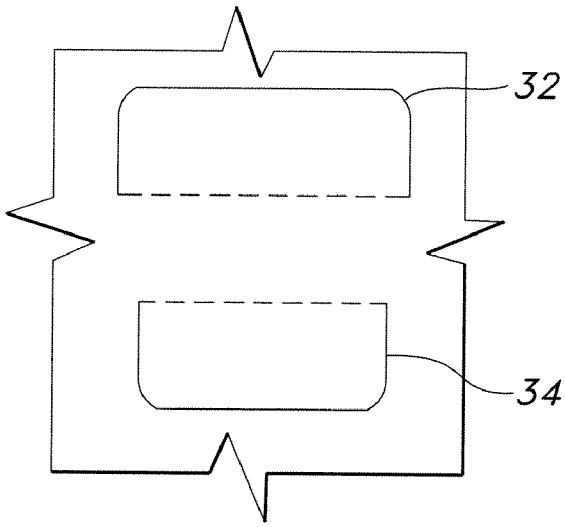
Figure 9C:
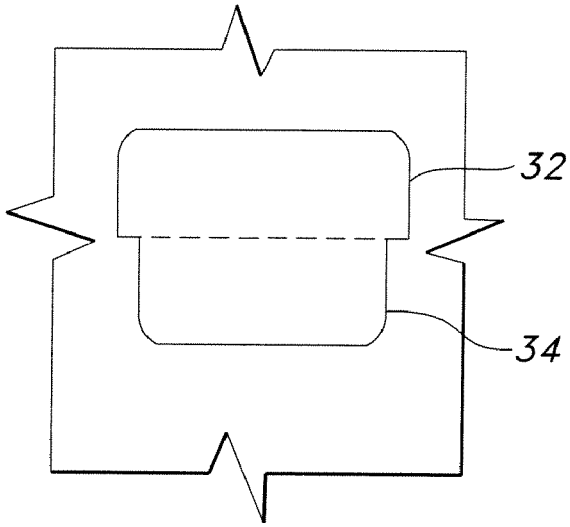

Turning now to FIG. 9 there is shown a series of tabs 32, 34 that may be used in the practice of the disclosure. FIG. 9A shows a generally rectangular tab arrangement where the tabs 32, 34 are the same size and are separated from each other by a small distance. FIG. 9B shows a tab arrangement with the tabs 32, 34 of differing size, again separated from each other by a small amount. FIG. 9C shows tabs 32, 34 of differing size but without a separating distance between them. Any of these tab arrangements may be used in the practice of this disclosure. In addition, the tabs 32, 34 may be of different shapes; e.g. rounded, elliptical, or shaped like the letters "M", "V", "U", "W" etc. When the tabs are separated by a distance, two fold or hinge lines are necessary (shown by dashed lines in FIGS. 9A and 9B). When they are not separated (FIG. 9C) only one fold or hinge line is necessary. It is believed that tabs that are separated by a distance would have somewhat greater holding power than tabs having a single hinge line. A single hinge line can result in very little attachment between the tabs and the blank 10 into which they are cut (see FIG. 9C) and so they may be more prone to being torn off the blank 10 with the application of moderate pulling force exerted on the merchandise.

In addition, indicia of the contents or other advertizing information may be provided on the display. The back 15 of the middle panel 14 will be facing outwardly and so be the most prominent panel once the display is completed so this panel 14 may be labeled with the proper identifying and or pricing (e.g. SKU) information. The front of the upper panel 16 will also be visible in part (the upper section) so this would be an appropriate panel for labeling as well.

In addition to the product disclosed above, also contemplated in this disclosure is a method of displaying merchandise. The method includes the steps of inserting the upper portion of a bag in which merchandise is placed, through a slot between the first and second panels of a three panel blank. The bag is attached to the tab arrangement on the first panel by inserting the tab arrangement through the slit on the upper portion of the bag. The upper edge of the upper panel is then inserted through the slot between the second and third panels to bring the second panel against the first panel to hold the tabs in place. Lastly, the third panel is folded down over the back of the first panel.

As used herein and in the claims, the term "comprising" is inclusive or open-ended and does not exclude additional unrecited elements, compositional components, or method steps.

While the disclosure has been described in detail with respect to specific embodiments thereof, it will be apparent to those skilled in the art that various alterations, modifications and other changes may be made to the disclosure without departing from the spirit and scope of the present disclosure. It is therefore intended that the claims cover all such modifications, alterations and other changes encompassed by the appended claims.

I claim:

1. A display device for merchandise comprising a blank having upper, middle and lower panels and an upper edge, said panels separated from each other by first and second slots running along upper and lower fold lines, a tab arrangement on said upper panel for holding merchandise to be displayed; and means for hanging the device located on said upper panel.

2. The display device of claim 1 wherein merchandise is packaged in a bag adapted to attach to said tab arrangement.

3. A display device for merchandise comprising a blank having upper, middle and lower panels and an upper edge, said panels separated from each other by fold lines, a tab arrangement on said upper panel for holding merchandise to be displayed; and means for hanging the device located on said upper panel wherein said merchandise is packaged in a bag which is inserted through a slot between said upper and middle panels and attached to said tab arrangement.

4. The display device of claim 3 wherein said upper edge is inserted through said slot between said lower and middle panels and said lower panel folded over the upper panel.

5. The display device of claim 4 wherein said lower panel is attached to the upper panel after said lower panel is folder over the upper panel.

6. A display device for merchandise comprising a blank having upper, middle and lower panels and an upper edge, said panels separated from each other by fold lines, a tab arrangement on said upper panel for holding merchandise to be displayed; and means for hanging the device located on said upper panel, wherein said merchandise is packaged in a bag adapted to attach to said tab arrangement and wherein said bag has a slot on its upper end that is adapted to accept said tab arrangement.

7. A tri-fold display system for displaying merchandise comprising a blank made from a relatively stiff paperboard, plastic or equivalent material, the blank having a front and a back and divided into three sections; an upper panel a middle panel and a lower panel, the panels distinguished or divided from each along fold lines, said fold lines having slots therein.

8. A tri-fold display system for displaying merchandise comprising a blank made from a relatively stiff paperboard, plastic or equivalent material, the blank having a front and a back and divided into three sections; an upper panel a middle panel and a lower panel, the panels distinguished or divided from each along fold lines, wherein the middle and lower panels are separated by a first slot sufficient in size to allow the insertion of an upper edge of the upper panel into the slot when the blank is folded.

9. The system of claim 8 further comprising a second slot between the middle panel and the upper panel for the insertion of merchandise to be displayed.

10. The system of claim 9 further comprising a tab arrangement having an upper tab and a lower tab.

11. The system of claim 10 wherein said tabs are cut from the blank and have a common hinge or fold along line.

12. The system of claim 10 wherein said tabs are separated from each other by a distance.

13. The system of claim 10 wherein said merchandise is placed in a plastic bag having a slit at an upper end, said bag inserted through said second slot and the tab arrangement inserted in said slit to hold said bag on said blank, the bag also having score line or perforation to aid in separating a lower part of the bag from the display.

14. A method of displaying merchandise comprising the steps of inserting an upper portion of a bag holding said merchandise through a slot between a first and second panel of a three panel blank, attaching said bag to a tab arrangement on said first panel of said blank by inserting said tab arrangement through a slit on an upper portion of said bag, inserting an upper edge of said upper panel through a slot between said second panel and a third panel to bring said second panel against said first panel and folding said third panel against a back of said first panel.

* * * * *